US012798750B2

(12) United States Patent
Kubota et al.

(10) Patent No.: US 12,798,750 B2
(45) Date of Patent: Nov. 17, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventors: Yuta Kubota, Shizuoka (JP); Akihiro Tagata, Shizuoka (JP); Masanori Kurata, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 254 days.

(21) Appl. No.: 18/773,670

(22) Filed: Jul. 16, 2024

(65) Prior Publication Data

US 2025/0050992 A1 Feb. 13, 2025

(30) Foreign Application Priority Data

Aug. 10, 2023 (JP) ..... 2023-130678

(51) Int. Cl.
*B63H 25/42* (2006.01)
*B63H 25/02* (2006.01)

(52) U.S. Cl.
CPC ..... *B63H 25/02* (2013.01); *B63H 25/42* (2013.01); *B63H 2025/026* (2013.01)

(58) Field of Classification Search
CPC ... B63H 25/02; B63H 25/42; B63H 2025/026
See application file for complete search history.

(56) References Cited

U.S. PATENT DOCUMENTS

| | | | | |
|---|---|---|---|---|
| 6,325,010 | B1 * | 12/2001 | Gruenwald | B63H 25/46 114/151 |
| 2007/0089660 | A1 * | 4/2007 | Bradley | B63H 21/22 114/144 A |
| 2011/0166724 | A1 * | 7/2011 | Hiramatsu | B63H 25/42 702/85 |
| 2020/0255103 | A1 | 8/2020 | Yamamoto et al. | |

FOREIGN PATENT DOCUMENTS

| | | | |
|---|---|---|---|
| JP | 3057413 | B2 | 6/2000 |
| JP | 3493345 | B2 | 2/2004 |
| JP | 5337722 | B2 | 11/2013 |
| JP | 5599245 | B2 | 10/2014 |
| JP | 6876816 | B2 | 5/2021 |

* cited by examiner

*Primary Examiner* — Peter D Nolan
*Assistant Examiner* — Matthew Cobb
(74) *Attorney, Agent, or Firm* — Keating & Bennett, LLP

(57) ABSTRACT

A watercraft propulsion system includes a bow thruster provided at a bow of a hull to generate a propulsive force laterally of the hull, a traveling direction command generator to be operated by a user to issue a traveling direction command to indicate the traveling direction of the hull, and a controller configured or programmed to perform an azimuth holding control to maintain an azimuth of the hull by controlling the bow thruster when the traveling direction command generator outputs an anteroposterior direction command to indicate a traveling direction parallel to an anteroposterior direction of the hull, and to stop the azimuth holding control after the azimuth holding control is continued for a predetermined period of time when the anteroposterior direction command is no longer outputted during the azimuth holding control.

9 Claims, 10 Drawing Sheets

WATERCRAFT PROPULSION SYSTEM, AND WATERCRAFT

CROSS REFERENCE TO RELATED APPLICATIONS

This application claims the benefit of priority to Japanese Patent Application No. 2023-130678 filed on Aug. 10, 2023. The entire contents of this application are hereby incorporated herein by reference.

BACKGROUND OF THE INVENTION

1. Field of the Invention

The present invention relates to watercraft propulsion systems, and watercraft including the watercraft propulsion systems.

2. Description of the Related Art

JP 3057413 B2 discloses an automatic steering device that issues a hull movement direction command and a hull movement speed command by a joystick lever and issues a hull bow turning direction command and a hull bow turning speed command by a bow turning dial. When the joystick lever and the bow turning dial are both in their neutral positions, an azimuth holding operation is performed to maintain a bow azimuth by computing thrust allocations among a rudder, a bow thruster, a stern thruster, and a propulsion propeller. When the joystick lever is in a non-neutral position and the bow turning dial is in the neutral position, an operation is performed to translate a hull with the bow azimuth maintained.

SUMMARY OF THE INVENTION

The inventor of example embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

In the prior art disclosed in JP 3057413 B2, the azimuth holding operation is continuously performed to maintain the bow azimuth when the joystick lever is in the neutral position. If the azimuth holding operation is constantly continued when the joystick lever is in the neutral position, however, there is a possibility that the bow thruster and the like are driven more than necessary.

Where an electric bow thruster is used, for example, it is preferred to efficiently drive the bow thruster only when necessary in consideration of battery consumption, heat generation due to the continuous operation, and the like. Therefore, the prior art still has room for improvement.

In view of the foregoing, example embodiments of the present invention provide watercraft propulsion systems that are each able to properly perform an azimuth holding operation by efficiently driving a bow thruster, and watercraft including the watercraft propulsion systems.

In order to overcome the previously unrecognized and unsolved challenges described above, an example embodiment of the present invention provides a watercraft propulsion system including a bow thruster provided at a bow of a hull to generate a propulsive force laterally of the hull, a propulsion device provided on the hull to generate a propulsive force anteroposteriorly of the hull, and a steering to change the course of the hull. The watercraft propulsion system further includes a joystick to be operated by a user (watercraft operator) to issue a traveling direction command to indicate the traveling direction of the hull, and tiltable from its neutral tilt position in all directions, and a controller configured or programmed to control the bow thruster, the propulsion device, and the steering according to an operation of the joystick. The controller is configured or programmed to perform an azimuth holding control to maintain the azimuth of the hull by controlling the bow thruster if an anteroposterior direction command is issued to indicate a traveling direction parallel to the anteroposterior direction of the hull by the operation of the joystick. The controller is further configured or programmed to stop the azimuth holding control after the azimuth holding control is continued for a predetermined period of time if the anteroposterior direction command is no longer issued with the joystick returned to the neutral tilt position during the azimuth holding control.

With this arrangement, the azimuth holding control is performed by utilizing the lateral propulsive force of the bow thruster if the anteroposterior direction command is issued to the controller by the operation of the joystick. This alleviates a burden on the user to perform an operation against a change in bow azimuth due to an external disturbance or the like. This azimuth holding control is continued even after the anteroposterior direction command is no longer issued with the joystick returned to the neutral tilt position. Therefore, the azimuth of the hull is maintained even during the inertial forward or reverse traveling of the hull. This continuously alleviates a burden on the user to perform an operation to correct an unintended change in bow azimuth. On the other hand, the azimuth holding control is continued only for the predetermined period of time and thereafter stopped such that the bow thruster is prevented from being continuously driven for a prolonged period of time of time longer than necessary. Thus, the watercraft propulsion system is able to efficiently drive the bow thruster to properly perform the azimuth holding operation.

The azimuth holding control is typically a control operation to be performed to maintain the azimuth of the hull observed when the azimuth holding control is started.

In an example embodiment of the present invention, the controller is configured or programmed to cancel a measurement of the predetermined period of time and perform the azimuth holding control if the anteroposterior direction command is issued again by the operation of the joystick during the azimuth holding control continued for the predetermined period of time.

With this arrangement, the azimuth holding control is restarted, if the anteroposterior direction command is issued again by the operation of the joystick during the azimuth holding control after the joystick is returned to the neutral tilt position to nullify the anteroposterior direction command. This makes it possible to practically extend the period of time of the azimuth holding control by the operation of the joystick. Thus, the bow thruster is efficiently driven according to the intention of the user to properly perform the azimuth holding operation.

In an example embodiment of the present invention, the watercraft propulsion system further includes a twist operator to be operated by the user to issue a bow turning command to indicate the bow turning of the hull, and that is rotatable leftward and rightward from its neutral twist position. The controller is configured or programmed not to start the azimuth holding control if the bow turning command is inputted from the twist operator, and to stop the azimuth holding control if the bow turning command is inputted from the twist operator during the azimuth holding control.

With this arrangement, the user is able to turn the bow of the hull by rotating the twist operator leftward and rightward. When the bow turning command is inputted from the twist operator to the controller, the azimuth holding control is not performed. If the bow turning command is inputted to the controller during the azimuth holding control, the azimuth holding control is stopped. Therefore, the azimuth holding control is prevented from interfering with the bow turning command, thus making it possible to efficiently utilize the propulsive force of the bow thruster.

The joystick may double as the twist operator. That is, the joystick may be configured to be tiltable and rotatable (twistable), and the joystick may be correspondingly configured to output the traveling direction command and the bow turning command.

In an example embodiment of the present invention, the controller is configured or programmed not to start the azimuth holding control when a command indicating a traveling direction nonparallel to the anteroposterior direction of the hull is issued by the operation of the joystick. Further, the controller is configured or programmed to stop the azimuth holding control if the command indicating the traveling direction nonparallel to the anteroposterior direction of the hull is issued by the operation of the joystick during the azimuth holding control.

With this arrangement, the azimuth holding control is not performed when the command indicating the traveling direction nonparallel to the anteroposterior direction is issued. Thus, the azimuth holding control is prevented from interfering with the movement of the hull (particularly, involving the turning of the hull). This makes it possible to efficiently utilize the propulsive force of the bow thruster.

Another example embodiment of the present invention provides a watercraft propulsion system including a bow thruster provided at a bow of a hull to generate a propulsive force laterally of the hull, a traveling direction command generator to be operated by a user (watercraft operator) to issue a traveling direction command to indicate the traveling direction of the hull, and a controller. The controller is configured or programmed to perform an azimuth holding control to maintain the azimuth of the hull by controlling the bow thruster if the traveling direction command generator outputs an anteroposterior direction command to indicate a traveling direction parallel to the anteroposterior direction of the hull, and to stop the azimuth holding control after the azimuth holding control is continued for a predetermined period of time if the anteroposterior direction command is no longer outputted during the azimuth holding control.

With this arrangement, the azimuth holding control is performed by utilizing the lateral propulsive force of the bow thruster if the anteroposterior direction command is issued to the controller by the operation of the traveling direction command generator. This alleviates a burden on the user to perform an operation against a change in bow azimuth due to an external disturbance or the like. This azimuth holding control is continued even after the anteroposterior direction command is no longer issued. Thus, the azimuth of the hull is maintained even during the inertial forward or reverse traveling of the hull. This continuously alleviates a burden on the user to perform an operation to correct an unintended change in bow azimuth. On the other hand, the azimuth holding control is continued only for the predetermined period of time and thereafter stopped, thus preventing the bow thruster from being continuously driven for a prolonged period of time longer than necessary. Thus, the watercraft propulsion system efficiently drives the bow thruster to properly perform the azimuth holding operation.

In an example embodiment of the present invention, the bow thruster is fixed to the hull in an unsteerable manner.

Another further example embodiment of the present invention provides a watercraft including a hull, and a watercraft propulsion system including any of the features described above.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
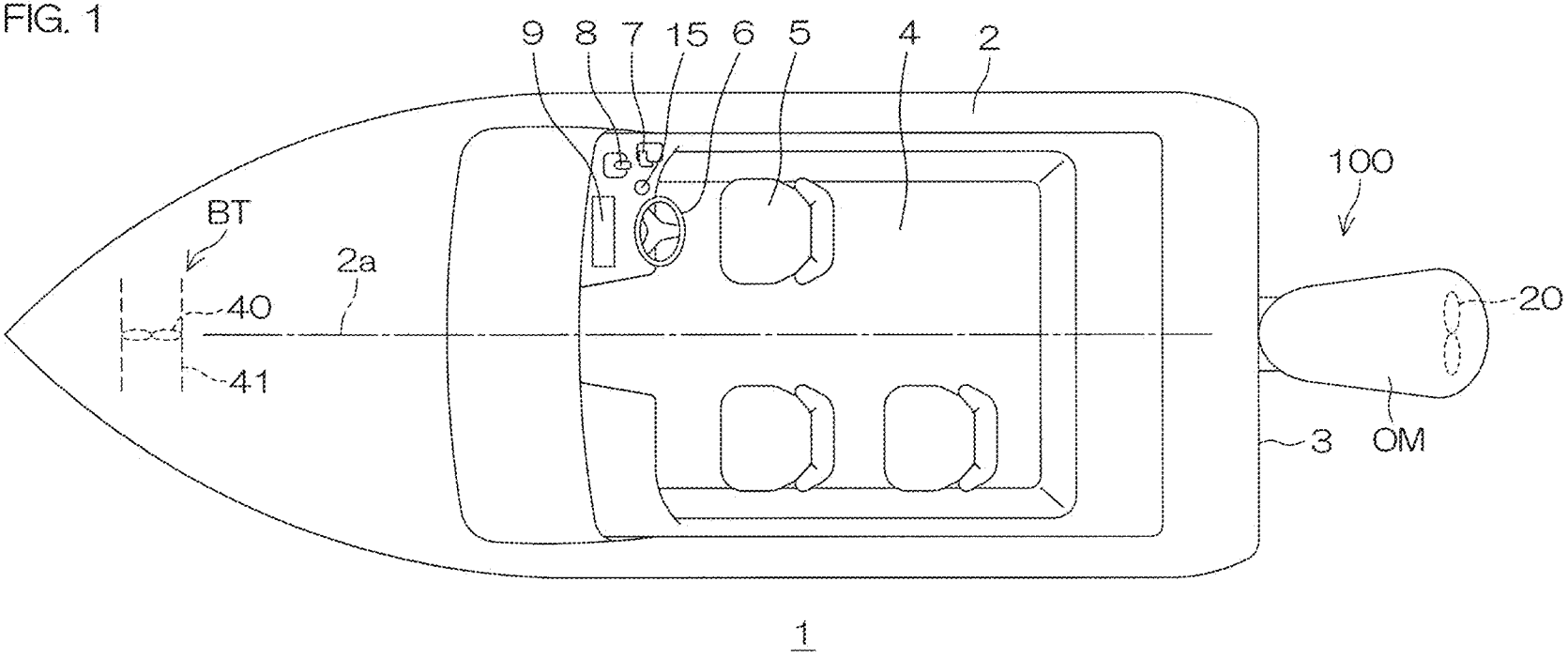
FIG. 1 is a plan view showing an exemplary construction of a watercraft mounted with a watercraft propulsion system according to an example embodiment of the present invention.

FIG. 1 is a plan view showing an exemplary construction of a watercraft 1 mounted with a watercraft propulsion system 100 according to an example embodiment of the present invention. The watercraft 1 includes a hull 2, a bow thruster BT provided at the bow of the hull 2 to generate a lateral propulsive force, and an outboard motor OM (an example of the propulsion device) provided on the stern 3 of the hull 2 and having a variable steering angle. In the present example embodiment, the single outboard motor OM is provided on a center line 2*a* extending anteroposteriorly of the hull 2 by way of an example, but a plurality of outboard motors OM, more specifically, two or more outboard motors OM, may be provided on the stern 3.

The outboard motor OM includes a propeller 20 located underwater, and is configured to generate a propulsive force by the rotation of the propeller 20 and apply the propulsive force to the hull 2. The outboard motor OM is attached to the stern 3 pivotably leftward and rightward such that the direction of the propulsive force generated by the propeller 20 is changed leftward and rightward. The steering angle is defined, for example, as an angle between the direction of the propulsive force generated by the propeller 20 and an anteroposterior reference direction parallel to the center line 2*a*. The outboard motor OM is configured to be pivoted leftward and rightward by a steering mechanism 26 thereof (see FIG. 2) to thus change the steering angle. When the propulsive force direction is parallel to the anteroposterior direction, the steering angle is zero. When the rear end of the outboard motor OM is directed rightward, the steering angle may be expressed with a positive sign. When the rear end of the outboard motor OM is directed leftward, the steering angle may be expressed with a negative sign.

The bow thruster BT includes a propeller 40 disposed in a tubular tunnel 41 extending through the bow portion of the hull 2 transversely of the hull 2. The propeller 40 may include, for example, two propellers connected to the opposite ends of its rotation shaft. The propeller 40 is rotatable in a forward rotation direction and a reverse rotation direction, i.e., is bidirectionally rotatable, such that the bow thruster BT is able to apply a rightward or leftward propulsive force to the hull 2. In the present example embodiment, the direction of the propulsive force to be generated by the bow thruster BT is not changeable to a direction other than the rightward direction and the leftward direction. That is, the bow thruster BT is fixed to the hull 2 in an unsteerable manner in the present example embodiment.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator to be operated by a user (watercraft operator) to change the course of the watercraft 1. The remote control lever 7 is an operator to be operated by the user to change the magnitude (output) and the direction (a forward or reverse direction) of the propulsive force of the outboard motor OM, and corresponds to an acceleration operator. The joystick 8 is an operator to be operated instead of the steering wheel 6 and the remote control lever 7 by the user for watercraft maneuvering. An operator 45 (see FIG. 2) dedicated for the operation of the bow thruster BT may be provided in addition to the aforementioned operators.

Figure 2:
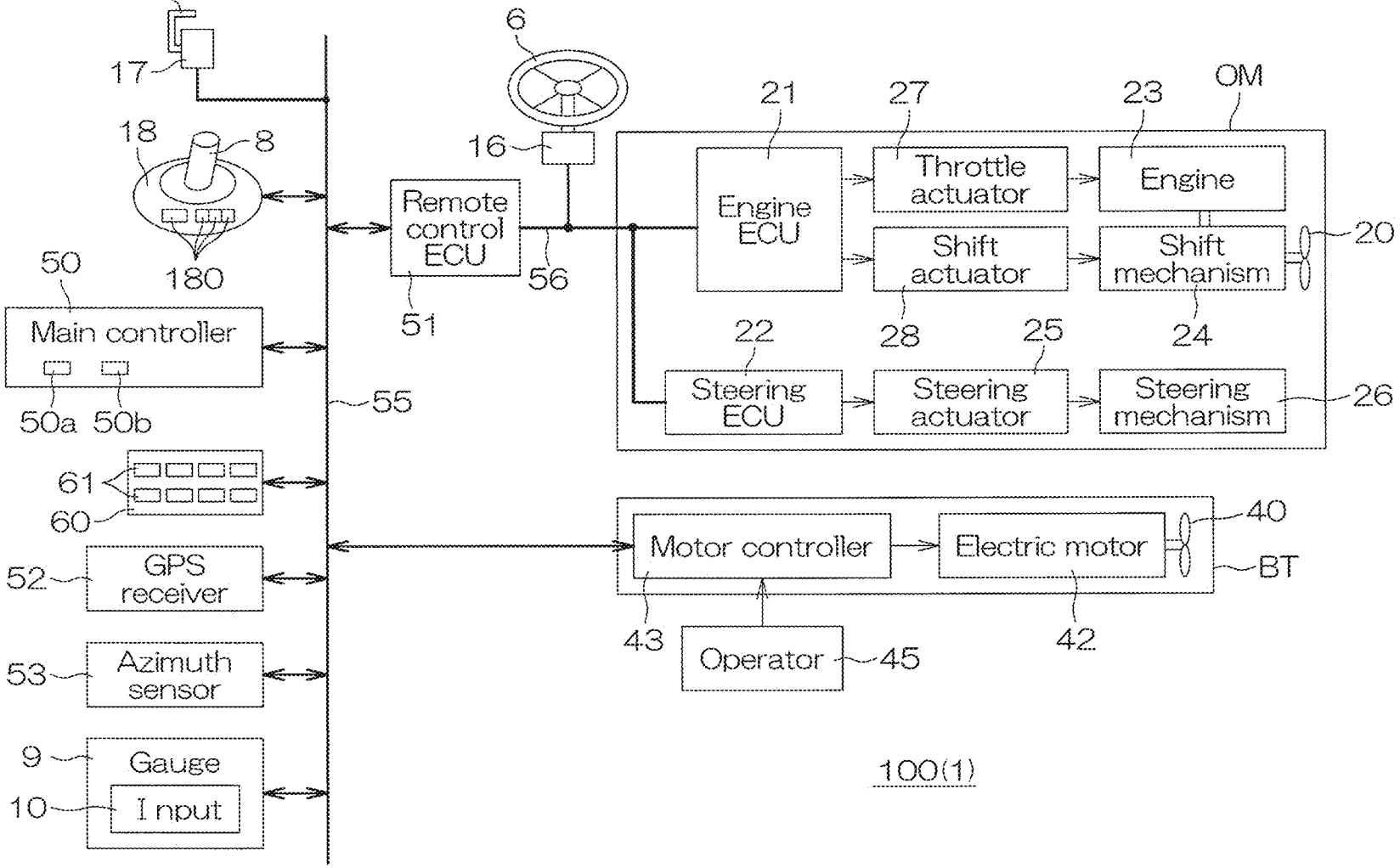
FIG. 2 is a block diagram showing a configuration of the watercraft propulsion system by way of an example.

FIG. 2 is a block diagram showing the configuration of the watercraft propulsion system 100 provided in the watercraft 1 by way of an example. The watercraft propulsion system 100 includes the outboard motor OM and the bow thruster BT. The outboard motor OM may be an engine outboard motor or an electric outboard motor. In FIG. 2, the engine outboard motor is illustrated as the outboard motor OM by way of an example.

The outboard motor OM includes an engine ECU (Electronic Control Unit) 21, a steering ECU 22, an engine 23, a shift mechanism 24, the propeller 20, the steering mechanism 26 and the like. Power generated by the engine 23 is transmitted to the propeller 20 via the shift mechanism 24. The steering mechanism 26 is configured to pivot the body of the outboard motor OM leftward and rightward with respect to the hull 2 (see FIG. 1) to change the direction of the propulsive force generated by the outboard motor OM leftward and rightward. The shift mechanism 24 is configured to select a shift position from a forward shift position, a reverse shift position, and a neutral shift position. With the shift position set to the forward shift position, the propeller 20 is rotated in a forward rotation direction by the transmission of the rotation of the engine 23 such that the outboard motor OM is brought into a forward drive state to generate a forward propulsive force. With the shift position set to the reverse shift position, the propeller 20 is rotated in a reverse rotation direction by the transmission of the rotation of the engine 23 such that the outboard motor OM is brought into a reverse drive state to generate a reverse propulsive force. With the shift position set to the neutral shift position, the power transmission between the engine 23 and the propeller 20 is interrupted such that the outboard motor OM is brought into an idling state.

The outboard motor OM further includes a throttle actuator 27 and a shift actuator 28, which are controlled by the engine ECU 21. The throttle actuator 27 is an electric actuator (typically including an electric motor) that actuates the throttle valve (not shown) of the engine 23. The shift actuator 28 is an actuator that actuates the shift mechanism 24. The outboard motor OM further includes a steering actuator 25 to be controlled by the steering ECU 22. The steering actuator 25 is the drive source of the steering mechanism 26, and typically includes an electric motor. The steering actuator 25 may include a hydraulic device of an electric pump type. The steering actuator 25 and the steering mechanism 26 are a non-limiting example of the steering that changes the course of the hull 2.

The bow thruster BT includes the propeller 40, an electric motor 42 that drives the propeller 40, and a motor controller 43 that controls the electric motor 42.

The watercraft propulsion system 100 further includes a main controller 50. The main controller 50 includes a processor 50*a* and a memory 50*b*, and is configured so that the processor 50*a* executes a program stored in the memory 50*b* to perform a plurality of functions. The main controller 50 is connected to an onboard network 55 (CAN: Control Area Network) provided in the hull 2. A remote control unit 17, a remote control ECU 51, a joystick unit 18, a GPS (Global Positioning System) receiver 52, an azimuth sensor 53 and the like are connected to the onboard network 55.

The remote control ECU 51 for the outboard motor OM is connected to the onboard network 55. The engine ECU 21 and the steering ECU 22 of the outboard motor OM are connected to the remote control ECU 51 via an outboard motor control network 56. The main controller 50 transmits and receives signals to/from various units connected to the onboard network 55 to control the outboard motor OM and the bow thruster BT, and further controls other units. The main controller 50 includes a plurality of control modes, and controls the units in predetermined manners according to the respective control modes.

A steering wheel unit 16 is connected to the outboard motor control network 56. The steering wheel unit 16 outputs an operation angle signal indicating the operation angle of the steering wheel 6 to the outboard motor control network 56. The operation angle signal is received by the remote control ECU 51 and the steering ECU 22. In response to the operation angle signal generated by the steering wheel unit 16 or a steering angle command generated by the remote control ECU 51, the steering ECU 22 correspondingly controls the steering actuator 25 to thus control the steering angle of the outboard motor OM.

The remote control unit 17 generates an operation position signal indicating the operation position of the remote control lever 7.

The joystick unit 18 generates an operation position signal indicating the operation position of the joystick 8, and generates an operation signal indicating the operation of any of operation buttons 180 provided in the joystick unit 18.

The remote control ECU 51 outputs a propulsive force command to the engine ECU 21 via the outboard motor control network 56. The propulsive force command includes a shift command indicating the shift position, and an output command indicating an engine output (specifically, an engine speed). Further, the remote control ECU 51 outputs the steering angle command to the steering ECU 22 via the outboard motor control network 56. The steering ECU 22 receives the detection signal of a steering angle sensor (not shown) that detects the steering angle of the steering mechanism 26. The steering ECU 22 controls the steering actuator 25 so that the actual steering angle detected by the steering angle sensor matches with the steering angle command issue from the remote control ECU 51. The actual steering angle detected by the steering angle sensor is transmitted to the remote control ECU 51 from the steering ECU 22, and further transmitted to the main controller 50 from the remote control ECU 51.

The remote control ECU 51 performs different control operations according to different control modes of the main controller 50. In a control mode for watercraft maneuvering with the use of the steering wheel 6 and the remote control lever 7, for example, the remote control ECU 51 generates the propulsive force command (the shift command and the output command) according to the operation position signal generated by the remote control unit 17, and applies the propulsive force command (the shift command and the output command) to the engine ECU 21. Further, the remote control ECU 51 commands the steering ECU 22 to conform to the operation angle signal generated by the steering wheel unit 16. In a control mode for watercraft maneuvering without the use of the steering wheel 6 and the remote control lever 7, on the other hand, the remote control ECU 51 conforms to commands issued by the main controller 50. That is, the main controller 50 generates the propulsive force command (the shift command and the output command) and the steering angle command, and the remote control ECU 51 outputs the propulsive force command (the shift command and the output command) and the steering angle command to the engine ECU 21 and the steering ECU 22, respectively. In a control mode for watercraft maneuvering with the use of the joystick 8 (joystick mode), for example, the main controller 50 generates the propulsive force command (the shift command and the output command) and the steering angle command according to the signals generated by the joystick unit 18. The magnitude and the direction (the forward direction or the reverse direction) of the propulsive force and the steering angle of the outboard motor OM are controlled according to the propulsive force command (the shift command and the output command) and the steering angle command thus generated.

The engine ECU 21 drives the shift actuator 28 according to the shift command to control the shift position, and drives the throttle actuator 27 according to the output command to control the throttle opening degree of the engine 23. The steering ECU 22 controls the steering actuator 25 according to the steering angle command to control the steering angle of the outboard motor OM.

The motor controller 43 of the bow thruster BT is connected to the onboard network 55, and is configured to actuate the electric motor 42 in response to a command issue from the main controller 50. The motor controller 43 may be connected to the onboard network 55 via a gateway (not shown). The main controller 50 issues a propulsive force command to the motor controller 43. The propulsive force command includes a shift command (rotation direction command) and an output command (rotation speed command). The shift command is a rotation direction command that indicates the stop, the forward rotation, or the reverse rotation of the propeller 40. The output command is a rotation speed command that indicates a propulsive force to be generated, specifically, a target rotation speed value. The motor controller 43 controls the rotation direction and the rotation speed of the electric motor 42 according to the shift command (rotation direction command) and the output command.

In this example, the operator 45 dedicated for the bow thruster BT is connected to the motor controller 43. The user is able to adjust the rotation direction and the rotation speed of the bow thruster BT by operating the operator 45.

The GPS receiver 52 is an exemplary position detection device. The GPS receiver 52 detects the position of the watercraft 1 by receiving radio waves from an artificial satellite orbiting the earth, and outputs position data indicating the position of the watercraft 1 and speed data indicating the moving speed of the watercraft 1. The main controller 50 acquires the position data and the speed data, which are used to control and display the position and/or the azimuth of the watercraft 1. GPS is a specific example of GNSS (Global Navigation Satellite System).

The azimuth sensor 53 detects the azimuth of the watercraft 1 to generate azimuth data, which is used by the main controller 50.

The gauge 9 is connected to the onboard network 55. The gauge 9 is a display device that displays various information for the watercraft maneuvering. The gauge 9 is able to communicate, for example, with the main controller 50, the remote control ECU 51, and the motor controller 43. Thus, the gauge 9 is able to display the operation state of the outboard motor OM, the operation state of the bow thruster BT, the position and/or the azimuth of the watercraft 1, and other information. The gauge 9 may include an input device 10 such as a touch panel and buttons. The input device 10 may be operated by the user to set various settings and give various commands such that operation signals are outputted to the onboard network 55. An additional network other than the onboard network 55 may be provided to transmit display control signals related to the gauge 9.

Further, an application switch panel 60 is connected to the onboard network 55. The application switch panel 60 includes a plurality of function switches 61 to be operated to issue predefined function commands. For example, the function switches 61 may include switches for automatic watercraft maneuvering commands. More specifically, a command for a bow holding mode (Heading Hold) in which an automatic steering operation is performed to maintain the bow azimuth during forward sailing may be assigned to one of the function switches 61, and a command for a straight sailing holding mode (Course Hold) in which an automatic steering operation is performed to maintain the bow azimuth and a straight course during forward sailing may be assigned to another of the function switches 61. Further, a command for a checkpoint following mode (Track Point™) in which an automatic steering operation is performed to follow a course (route) passing through specified checkpoints may be assigned to further another of the function switches 61, and a command for a pattern sailing mode (Pattern Steer) in which an automatic steering operation is performed to follow a predetermined sailing pattern (zig-zag pattern, spiral pattern or the like) may be assigned to still another of the function switches 61.

Figure 3:
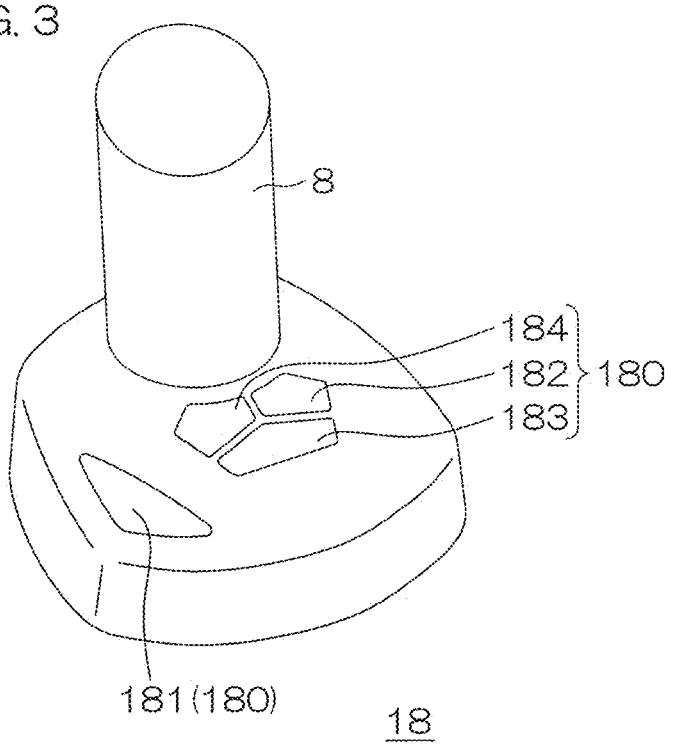
FIG. 3 is a perspective view showing a structure of a joystick unit by way of an example.

FIG. 3 is a perspective view showing the structure of the joystick unit 18 by way of example. The joystick unit 18 includes the joystick 8, which is tiltable forward, backward, leftward, and rightward (i.e., in all 360-degree directions) from its neutral tilt position, and is rotatable (twistable) leftward and rightward from its neutral twist position about its axis. In this example, the joystick unit 18 further includes the operation buttons 180. The operation buttons 180 includes a joystick button 181 and holding mode setting buttons 182 to 184.

The joystick button 181 is an operator to be operated by the user to select a control mode (watercraft maneuvering mode) utilizing the joystick 8, i.e., the joystick mode.

The holding mode setting buttons 182, 183, 184 are operation buttons to be operated by the user to select position/azimuth holding control modes (examples of an automatic watercraft maneuvering mode). More specifically, the holding mode setting button 182 is operated to select a fixed-point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 50 can be classified into an ordinary mode, the joystick mode, or the automatic watercraft maneuvering mode in terms of the operation system.

In the ordinary mode, a steering control operation is performed according to the operation angle signal generated by the steering wheel unit 16, and a propulsive force control operation is performed according to the operation signal (operation position signal) of the remote control lever 7. In the present example embodiment, the ordinary mode is a default control mode of the main controller 50. In the steering control operation, specifically, the steering ECU 22 drives the steering actuator 25 according to the operation angle signal generated by the steering wheel unit 16 or the steering angle command generated by the remote control ECU 51. Thus, the body of the outboard motor OM is steered leftward and rightward such that the propulsive force direction is changed leftward and rightward with respect to the hull 2. In the propulsive force control operation, specifically, the engine ECU 21 drives the shift actuator 28 and the throttle actuator 27 according to the propulsive force command (the shift command and the output command) issue from the remote control ECU 51 to the engine ECU 21. Thus, the shift position of the outboard motor OM is set to the forward shift position, the reverse shift position or the neutral shift position, and the engine output (specifically, the engine speed) of the outboard motor OM is changed.

In the joystick mode, the steering control operation and the propulsive force control operation are performed according to the operation signal of the joystick 8 of the joystick unit 18.

In the joystick mode, the steering control operation and the propulsive force control operation are performed on the outboard motor OM. That is, the main controller 50 applies the steering angle command and the propulsive force command to the remote control ECU 51, and the remote control ECU 51 applies the steering angle command and the propulsive force command to the steering ECU 22 and the engine ECU 21, respectively.

In the automatic watercraft maneuvering mode, the steering control operation and/or the propulsive force control operation are automatically performed by the functions of the main controller 50 and the like without the operation of the steering wheel 6, the remote control lever 7, and the joystick 8. That is, the automatic watercraft maneuvering operation is performed. The automatic watercraft maneuvering operation includes an automatic watercraft maneuvering operation to be performed on a sailing basis during sailing, and an automatic watercraft maneuvering operation on a position/azimuth holding basis to maintain one or both of the position and the azimuth. Examples of the automatic watercraft maneuvering operation on the sailing basis include the automatic steering operations to be selected by operating the function switches 61. Examples of the automatic watercraft maneuvering operation on the position/azimuth holding basis include watercraft maneuvering operations to be performed in the fixed-point holding mode, the position holding mode, and the azimuth holding mode, which are respectively selected by operating the holding mode setting buttons 182, 183, and 184.

In the present example embodiment, a cooperative mode in which the outboard motor OM and the bow thruster BT cooperate to achieve an intended hull behavior or a non-cooperative mode in which the outboard motor OM and the bow thruster BT do not cooperate is selectable in the joystick mode and the automatic watercraft maneuvering mode. A selection operator to be operated by the user to select the cooperative mode or the non-cooperative mode, for example, may be assigned to any of the function switches 61 provided on the application switch panel 60. Alternatively, the selection of the cooperative mode or the non-cooperative mode may be achieved by operating the input device 10 of the gauge 9. In the cooperative mode, the main controller 50 performs the steering control operation and the propulsive force control operation on the outboard motor OM and, in addition, performs the propulsive force control operation on the bow thruster BT.

Figure 4:
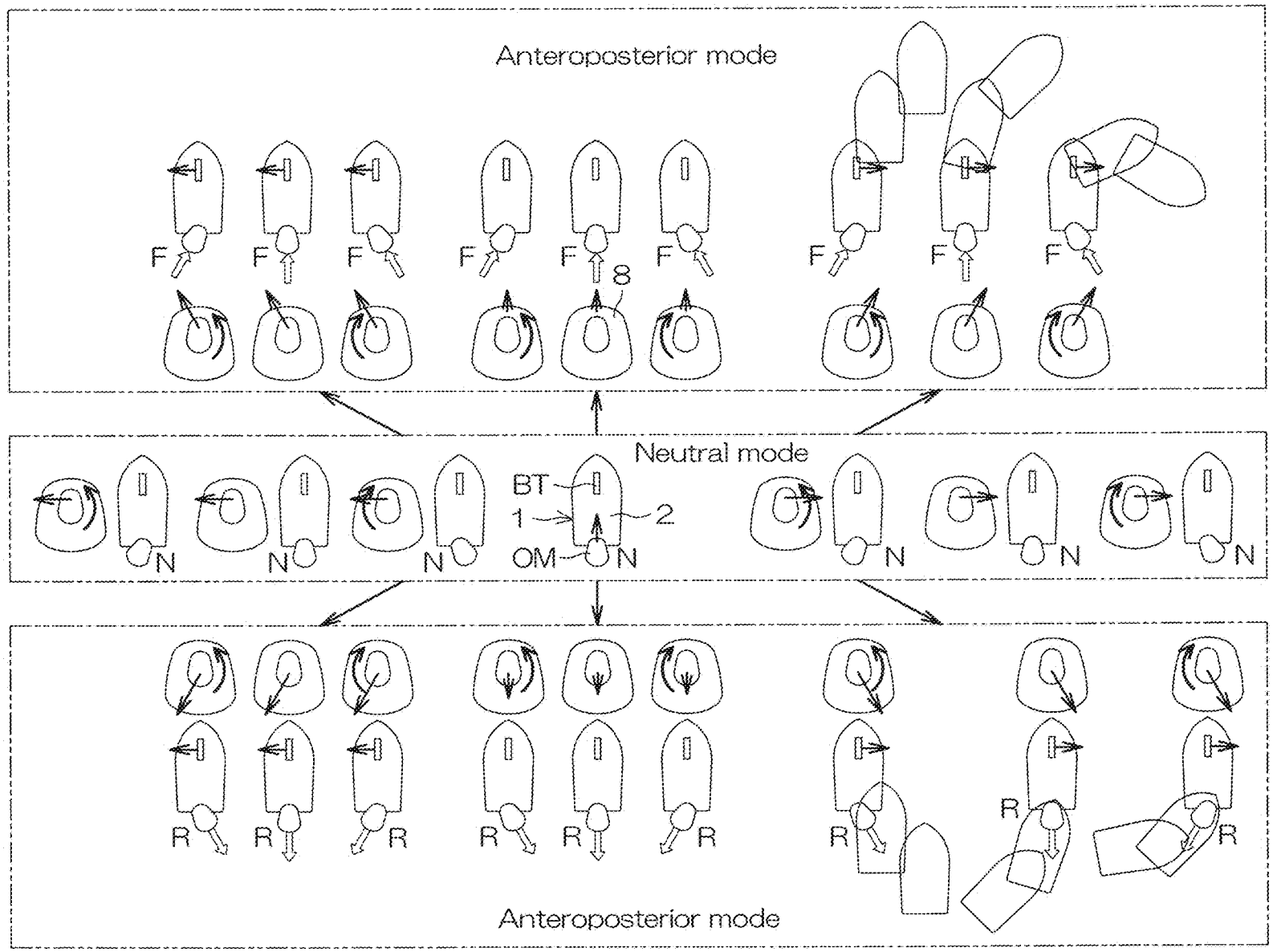
FIG. 4 is a diagram for describing a neutral mode and an anteroposterior mode, which are sub-modes of a joystick mode.
Figure 5:
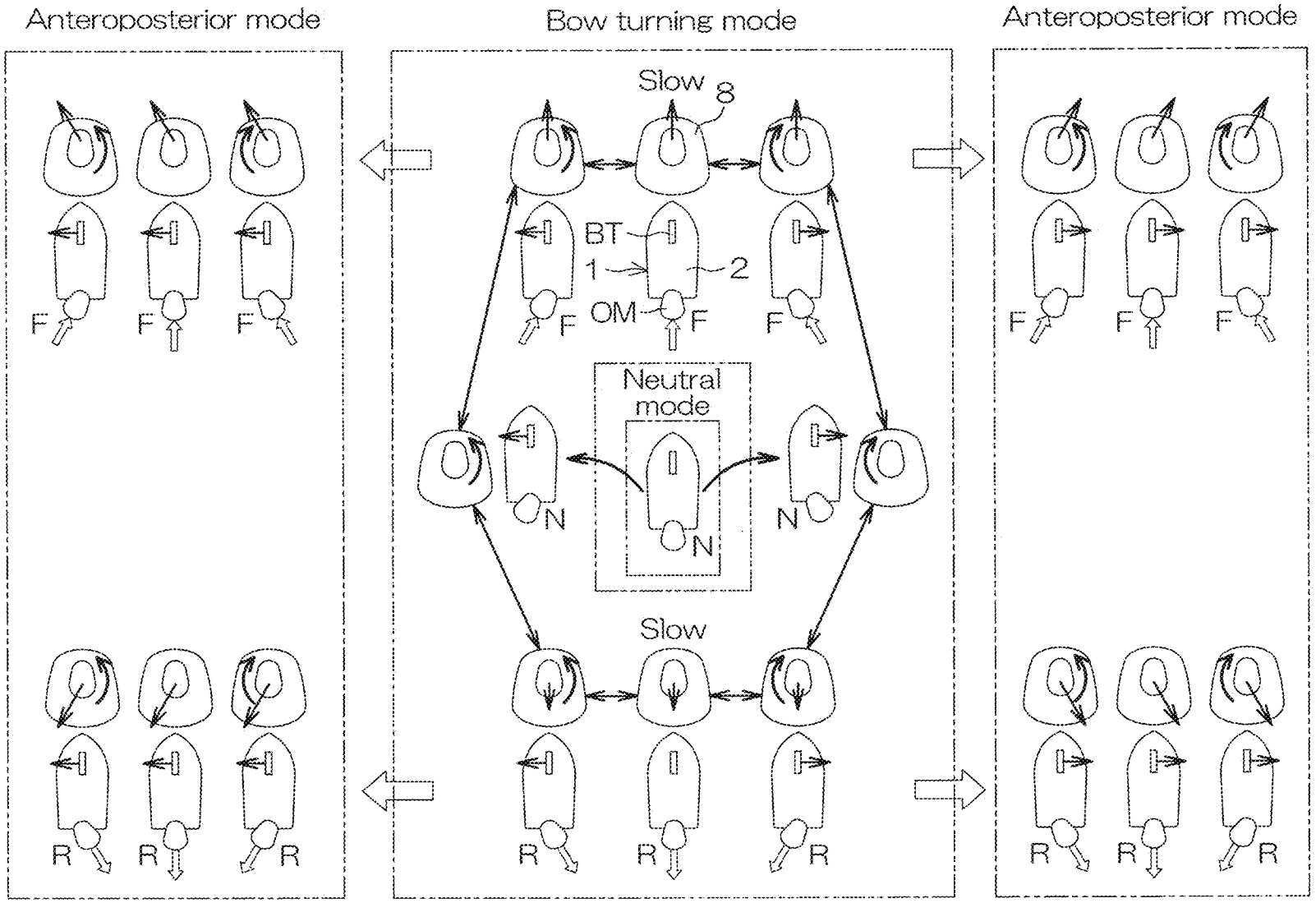
FIG. 5 is a diagram for describing the neutral mode and a bow turning mode, which are sub-modes of the joystick mode.

FIGS. 4 and 5 are diagrams for describing the joystick mode in the cooperative mode, showing the operation states of the joystick 8 and the corresponding behaviors of the hull 2. In the joystick mode, the main controller 50 includes a plurality of sub-modes (control modes) including a neutral mode in which no propulsive force is applied to the hull 2, a bow turning mode in which the bow of the hull 2 is turned, and an anteroposterior mode in which the hull 2 is anteroposteriorly moved. When the joystick 8 is in the neutral tilt position and the neutral twist position, the main controller 50 is in the neutral mode. In the neutral mode, the main controller 50 controls the propulsive force of the bow thruster BT to zero, sets the shift position of the outboard motor OM to the neutral shift position N, and controls the steering angle of the outboard motor OM to zero. When the joystick 8 is tilted from the neutral tilt position in the neutral twist position, the main controller 50 is switched from the neutral mode to the anteroposterior mode. This operation is shown in FIG. 4. Further, when the joystick 8 is twisted from the neutral twist position and the neutral tilt position, the main controller 50 is switched from the neutral mode to the bow turning mode. This operation is shown in FIG. 5.

Figure 6:
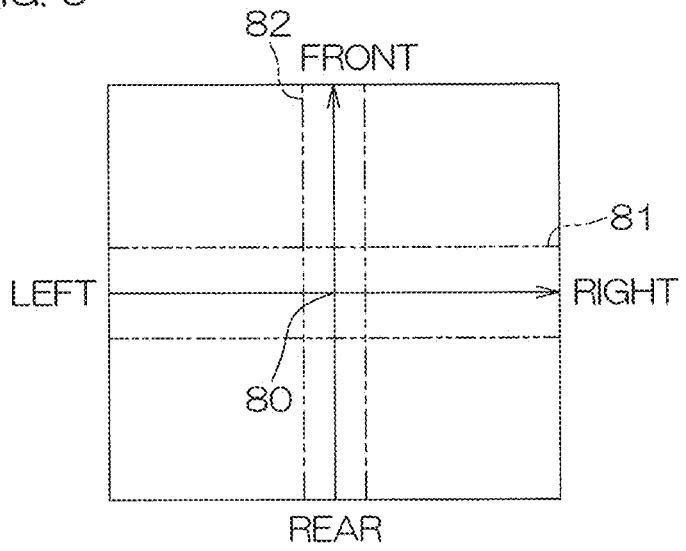
FIG. 6 is a diagram showing an anteroposterior insensitive zone and a lateral insensitive zone of a joystick.

Referring to FIG. 4, the main controller 50 is switched into the anteroposterior mode when the joystick 8 is operated anteroposteriorly in the neutral mode. The main controller 50 determines that the joystick 8 is operated anteroposteriorly, if the anteroposterior component of the tilt amount of the joystick 8 from the neutral tilt position 80 (see FIG. 6) (hereinafter referred to simply as "tilt amount") falls outside a predetermined anteroposterior insensitive zone 81 (see FIG. 6). The main controller 50 determines that the joystick 8 is operated laterally if the lateral component of the tilt amount of the joystick 8 falls outside a lateral insensitive zone 82 (see FIG. 6).

In the anteroposterior mode, the main controller 50 causes the bow thruster BT to generate the propulsive force according to the lateral component of the tilt amount of the joystick 8. Further, the main controller 50 causes the outboard motor OM to generate the propulsive force according to the anteroposterior component of the tilt amount of the joystick 8. Further, the main controller 50 controls the steering angle of the outboard motor OM by controlling the steering actuator 25 according to the twisting of the joystick 8 to drive the steering mechanism 26.

More specifically, if the joystick 8 is tilted straight forward from the neutral tilt position, the main controller 50 controls the propulsive force of the bow thruster BT to zero, sets the shift position of the outboard motor OM to the forward shift position F, controls the magnitude of the propulsive force of the outboard motor OM according to the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction (rotating direction) of the joystick 8. That is, the steering direction of the outboard motor OM corresponds to the twisting direction of the joystick 8, and the steering amount of the outboard motor OM corresponds to the twisting amount (rotating amount) of the joystick 8. The twisting amount is a twisting amount from the neutral twist position of the joystick 8 (this definition also applies to the following description). The propulsive force of the bow thruster BT is kept at zero. Thus, the user is able to adjust the steering of the outboard motor OM by the twisting of the joystick 8, while adjusting the propulsive force of the outboard motor OM by the forward tilt amount of the joystick 8.

If the joystick 8 is tilted in a diagonally forward-right direction, the main controller 50 causes the bow thruster BT to generate a rightward propulsive force, and controls the magnitude of the rightward propulsive force according to the lateral component of the tilt amount of the joystick 8. Further, the main controller 50 sets the shift position of the outboard motor OM to the forward shift position F, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to the twisting direction of the joystick 8, and the steering amount of the outboard motor OM corresponds to the twisting amount of the joystick 8. The rightward propulsive force generated by the bow thruster BT applies a clockwise bow turning moment to the hull 2. Thus, if the joystick 8 is twisted counterclockwise, the outboard motor OM is steered leftward with respect to its neutral steering position (a position at which the steering angle is zero), and the propulsive force of the outboard motor OM applies a counterclockwise bow turning moment to the hull 2. Thus, the clockwise bow turning moment issued by the propulsive force of the bow thruster BT is reduced. Further, if the joystick 8 is twisted clockwise, the outboard motor OM is steered rightward with respect to the neutral steering position, and the propulsive force of the outboard motor OM applies a clockwise bow turning moment to the hull 2. Thus, the clockwise bow turning moment is added to the clockwise bow turning moment issued by the propulsive force of the bow thruster BT. Thus, the user is able to move the hull 2 in the diagonally forward-right direction by the tilting of the joystick 8, and is able to adjust the bow turning of the hull 2 by the twisting of the joystick 8. For example, the user is able to find a twist position of the joystick 8 at which the hull 2 is free from the bow turning, while operating the joystick 8, to thus cause the hull 2 to translate in the diagonally forward-right direction.

If the joystick 8 is tilted in a diagonally forward-left direction, the main controller 50 causes the bow thruster BT to generate a leftward propulsive force, and controls the magnitude of the leftward propulsive force according to the lateral component of the tilt amount of the joystick 8. Further, the main controller 50 sets the shift position of the outboard motor OM to the forward shift position F, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to the twisting direction of the joystick 8, and the steering amount of the outboard motor OM corresponds to the twisting amount of the joystick 8. The leftward propulsive force generated by the bow thruster BT applies a counterclockwise bow turning moment to the hull 2. Thus, if the joystick 8 is twisted clockwise, the outboard motor OM is steered rightward with respect to the neutral steering position, and the propulsive force of the outboard motor OM applies a clockwise bow turning moment to the hull 2. Thus, the counterclockwise bow turning moment issued by the propulsive force of the bow thruster BT is reduced. Further, if the joystick 8 is twisted counterclockwise, the outboard motor OM is steered leftward with respect to the neutral steering position, and the propulsive force of the outboard motor OM applies a counterclockwise bow turning moment to the hull 2. Thus, the counterclockwise bow turning moment is added to the counterclockwise bow turning moment issued by the propulsive force of the bow thruster BT. Thus, the user is able to move the hull 2 in the diagonally forward-left direction by the tilting of the joystick 8, and is able to adjust the bow turning of the hull 2 by the twisting of the joystick 8. For example, the user is able to find a twist position of the joystick 8 at which the hull 2 is free from the bow turning, while operating the joystick 8, to thus cause the hull 2 to translate in the diagonally forward-left direction.

If the joystick 8 is tilted straight rearward from the neutral tilt position, the main controller 50 controls the propulsive force of the bow thruster BT to zero, sets the shift position of the outboard motor OM to the reverse shift position R, controls the magnitude of the propulsive force of the outboard motor OM according to the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The propulsive force of the bow thruster BT is kept at zero. Thus, the user is able to adjust the steering of the outboard motor OM by the twisting of the joystick 8 while adjusting the propulsive force of the outboard motor OM by the rearward tilt amount of the joystick 8.

If the joystick 8 is tilted in a diagonally rearward-right direction, the main controller 50 causes the bow thruster BT to generate a rightward propulsive force, and controls the magnitude of the rightward propulsive force according to the lateral component of the tilt amount of the joystick 8. Further, the main controller 50 sets the shift position of the outboard motor OM to the reverse shift position R, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The rightward propulsive force generated by the bow thruster BT applies a clockwise bow turning moment to the hull 2. Thus, if the joystick 8 is twisted counterclockwise, the outboard motor OM is steered rightward with respect to the neutral steering position, and the propulsive force of the outboard motor OM applies a counterclockwise bow turning moment to the hull 2. Thus, the clockwise bow turning moment issued by the propulsive force of the bow thruster BT is reduced. Further, if the joystick 8 is twisted clockwise, the outboard motor OM is steered leftward, and the propulsive force of the outboard motor OM applies a clockwise bow turning moment to the hull 2. Thus, the clockwise bow turning moment is further added to the clockwise bow turning moment issued by the propulsive force of the bow thruster BT. Thus, the user is able to move the hull 2 in the diagonally rearward-right direction by the tilting of the joystick 8, and is able to adjust the bow turning of the hull 2 by the twisting of the joystick 8. For example, the user is able to find a twist position of the joystick 8 at which the hull 2 is free from the bow turning, while operating the joystick 8, to thus cause the hull 2 to translate in the diagonally rearward-right direction.

If the joystick 8 is tilted in a diagonally rearward-left direction, the main controller 50 causes the bow thruster BT to generate a leftward propulsive force, and controls the magnitude of the leftward propulsive force according to the lateral component of the tilt amount of the joystick 8. Further, the main controller 50 sets the shift position of the outboard motor OM to the reverse shift position R, controls the magnitude of the propulsive force of the outboard motor OM according to the anteroposterior component of the tilt amount of the joystick 8, and controls the steering angle of the outboard motor OM to zero. If the joystick 8 is thereafter twisted, the main controller 50 steers the outboard motor OM so as to promote the bow turning of the hull 2 in a direction corresponding to the twisting direction of the joystick 8. That is, the steering direction of the outboard motor OM corresponds to a direction opposite to the twisting direction of the joystick 8, and the steering amount of the outboard motor OM corresponds to the twisting amount of the joystick 8. The leftward propulsive force generated by the bow thruster BT applies a counterclockwise bow turning moment to the hull 2. Thus, if the joystick 8 is twisted clockwise, the outboard motor OM is steered leftward with respect to the neutral steering position, and the propulsive force of the outboard motor OM applies a clockwise bow turning moment to the hull 2. Thus, the counterclockwise bow turning moment issued by the propulsive force of the bow thruster BT is reduced. Further, if the joystick 8 is twisted counterclockwise, the outboard motor OM is steered rightward with respect to the neutral steering position, and the propulsive force of the outboard motor OM applies a counterclockwise bow turning moment to the hull 2. Thus, the counterclockwise bow turning moment is added to the counterclockwise bow turning moment issued by the propulsive force of the bow thruster BT. Thus, the user is able to move the hull 2 in the diagonally rearward-left direction by the tilt of the joystick 8, and is able to adjust the bow turning of the hull 2 by the twisting of the joystick 8. For example, the user is able to find a twist position of the joystick 8 at which the hull 2 is free from the bow turning, while operating the joystick 8, to thus cause the hull 2 to translate in the diagonally rearward-left direction.

It is noted that, even if the anteroposterior component of the tilt amount of the joystick 8 falls within the anteroposterior insensitive zone 81 (see FIG. 6) in the anteroposterior mode when the lateral component of the tilt amount of the joystick 8 falls outside the lateral insensitive zone 82 (see FIG. 6), the anteroposterior mode is maintained. This feature is not illustrated in FIG. 4 to avoid complication.

Even if the lateral component of the tilt amount of the joystick 8 falls outside the lateral insensitive zone 82 (see FIG. 6) when the anteroposterior component of the tilt amount of the joystick 8 falls within the anteroposterior insensitive zone 81 (see FIG. 6), the main controller 50 maintains the neutral mode, and the propulsive forces of the bow thruster BT and the outboard motor OM are controlled to zero. That is, the bow thruster BT is not driven, and the shift position of the outboard motor OM is set to the neutral shift position N.

When the anteroposterior component of the tilt amount of the joystick 8 falls within the anteroposterior insensitive zone 81 (see FIG. 6) and the lateral component of the tilt amount of the joystick 8 falls within the lateral insensitive zone 82 (see FIG. 6), the main controller 50 determines that the joystick 8 is in the neutral tilt position. When the twisting amount of the joystick 8 falls within a predetermined rotation insensitive zone, the main controller 50 determines that the joystick 8 is in the neutral twist position. When the joystick 8 is in the neutral tilt position and the neutral twist position, the main controller 50 is in the neutral mode. Even if the joystick 8 is tilted laterally from the neutral tilt position over the lateral insensitive zone 82 (see FIG. 6) in the neutral mode when the anteroposterior component of the tilt amount of the joystick 8 falls within the anteroposterior insensitive zone 81 (see FIG. 6), the main controller 50 maintains the neutral mode.

Referring next to FIG. 5, the main controller 50 is switched to the bow turning mode when the joystick 8 is twisted (rotated) in the neutral mode.

In the bow turning mode, the main controller 50 causes the bow thruster BT to generate a propulsive force according to the twisting of the joystick 8. Further, the main controller 50 steers the outboard motor OM according to the twisting of the joystick 8, and causes the outboard motor OM to generate a propulsive force according to the anteroposterior component of the tilt amount of the joystick 8.

More specifically, if the joystick 8 is twisted from the neutral twist position, the main controller 50 drives the bow thruster BT so as to promote the bow turning of the hull 2 in a direction corresponding to the twisting direction of the joystick 8. That is, if the joystick 8 is twisted clockwise from the neutral twist position, the main controller 50 causes the bow thruster BT to generate a rightward propulsive force, and controls the magnitude of the rightward propulsive force according to the twisting amount of the joystick 8 from the neutral twist position. Thus, a clockwise bow turning moment is applied to the hull 2. Further, if the joystick 8 is twisted counterclockwise from the neutral twist position, the main controller 50 causes the bow thruster BT to generate a leftward propulsive force, and controls the magnitude of the leftward propulsive force according to the twisting amount of the joystick 8 from the neutral twist position. Thus, a counterclockwise bow turning moment is applied to the hull 2. As long as the anteroposterior component of the tilt amount of the joystick 8 falls within the anteroposterior insensitive zone 81 (see FIG. 6), the main controller 50 sets the shift position of the outboard motor OM to the neutral shift position N so as to prevent the outboard motor OM from generating the propulsive force. Thus, a fixed-point bow turning behavior is achieved by utilizing the propulsive force of the bow thruster BT alone. In the bow turning mode, however, the main controller 50 may control the steering angle of the outboard motor OM according to the twisting of the joystick 8. This steering angle control may be performed in substantially the same manner as when the joystick 8 is tilted forward in the anteroposterior mode.

If the joystick 8 is twisted clockwise from the neutral twist position and, in this state, the joystick 8 is tilted straight forward, the main controller 50 sets the shift position of the outboard motor OM to the forward shift position F, and causes the outboard motor OM to generate a propulsive force having a magnitude corresponding to the anteroposterior component of the tilt amount of the joystick 8. At this time, the main controller 50 steers the outboard motor OM in a direction corresponding to the twisting of the joystick 8, i.e., steers the outboard motor OM rightward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a clockwise bow turning moment to the hull 2.

If the joystick 8 is twisted clockwise from the neutral twist position and, in this state, the joystick 8 is tilted straight rearward, on the other hand, the main controller 50 sets the shift position of the outboard motor OM to the reverse shift position R, and causes the outboard motor OM to generate a propulsive force having a magnitude corresponding to the anteroposterior component of the tilt amount of the joystick 8. At this time, the main controller 50 steers the outboard motor OM in a direction opposite to the twisting direction of the joystick 8, i.e., steers the outboard motor OM leftward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a clockwise bow turning moment to the hull 2.

If the joystick 8 is twisted counterclockwise from the neutral twist position and, in this state, the joystick 8 is tilted straight forward, the main controller 50 sets the shift position of the outboard motor OM to the forward shift position F, and causes the outboard motor OM to generate a propulsive force having a magnitude corresponding to the anteroposterior component of the tilt amount of the joystick 8. At this time, the main controller 50 steers the outboard motor OM in a direction corresponding to the twisting of the joystick 8, i.e., steers the outboard motor OM leftward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a counterclockwise bow turning moment to the hull 2.

If the joystick 8 is twisted counterclockwise from the neutral twist position and, in this state, the joystick 8 is tilted straight rearward, on the other hand, the main controller 50 sets the shift position of the outboard motor OM to the reverse shift position R, and causes the outboard motor OM to generate a propulsive force having a magnitude corresponding to the anteroposterior component of the tilt amount of the joystick 8. At this time, the main controller 50 steers the outboard motor OM in a direction opposite to the twisting direction of the joystick 8, i.e., steers the outboard motor OM rightward with respect to the neutral steering position. The steering amount of the outboard motor OM corresponds to the twisting amount of the joystick 8 from the neutral twist position. Thus, the propulsive force of the outboard motor OM, as well as the propulsive force of the bow thruster BT, applies a counterclockwise bow turning moment to the hull 2.

If the joystick 8 is tilted in any of the diagonal directions (i.e., in the forward-right direction, the rearward-right direction, the forward-left direction or the rearward-left direction) in the bow turning mode, the main controller 50 is switched into the anteroposterior mode. In the bow turning mode, the steering control operation is performed on the outboard motor OM according to the twisting of the joystick 8 as in the anteroposterior mode. Thus, even if the main controller 50 is switched into the anteroposterior mode from the bow turning mode, the continuity of the watercraft maneuvering feeling is not impaired.

Figure 7:
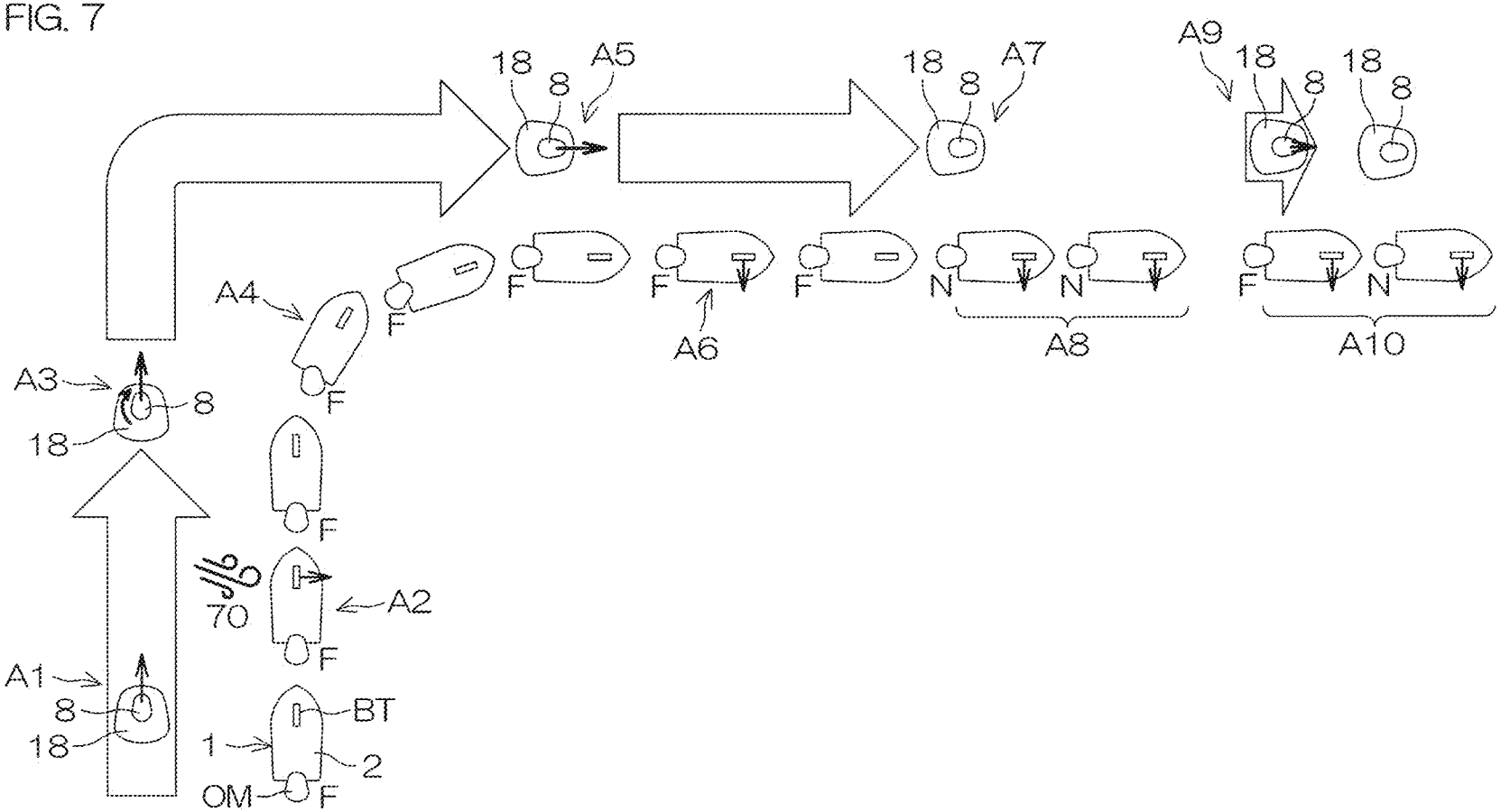
FIG. 7 is a diagram for describing the characteristic features of an azimuth holding control to be performed by the watercraft propulsion system, and showing the operation states of the joystick and corresponding hull behaviors by way of example.

FIG. 7 is a diagram for describing the characteristic features of an azimuth holding control to be performed by the watercraft propulsion system 100, showing the operation states of the joystick 8 and the corresponding behaviors of the hull 2 by way of example.

The joystick unit 18 is an example of the traveling direction command generator that gives a traveling direction command to indicate the traveling direction of the hull 2 by the tilt direction of the joystick 8. Further, the joystick unit 18 also serves as an exemplary propulsive force command generator that generates the propulsive force command according to the tilt amount of the joystick 8. Further, the joystick unit 18 is an example of the twist operator or a tilt/twist operator that generates a bow turning command to indicate the bow turning of the hull 2 according to the turning (twisting) of the joystick 8.

In the present example embodiment, if an anteroposterior direction command is issue from the joystick unit 18 to indicate a traveling direction parallel to the anteroposterior direction of the hull 2, the main controller 50 performs an azimuth holding control to maintain the azimuth of the hull 2 by controlling the bow thruster BT. When the anteroposterior component of the tilt amount of the joystick 8 falls outside the anteroposterior insensitive zone 81 (see FIG. 6) and the lateral component of the tilt amount of the joystick 8 falls within the lateral insensitive zone 82 (see FIG. 6), the main controller 50 regards the output of the joystick unit 18 as the anteroposterior direction command. That is, the anteroposterior direction command is issued to the main controller 50 by tilting the joystick 8 straight forward or straight rearward.

When the bow turning command is inputted from the joystick unit 18, the main controller 50 does not perform the azimuth holding control. When the twisting amount of the joystick 8 from the neutral twist position falls within the rotation insensitive zone, the main controller 50 determines that the bow turning command is not issued. When the twisting amount of the joystick 8 from the neutral twist position falls outside the rotation insensitive zone, the main controller 50 determines that the bow turning command is inputted. Thus, the azimuth holding control is effected by tilting the joystick 8 straight forward or straight rearward without twisting the joystick 8.

With reference to FIG. 7, specifically, if the joystick 8 is tilted straight forward but not twisted (reference character A1), an anteroposterior direction command is issued to the main controller 50 to indicate straight forward movement. Correspondingly, the main controller 50 applies a propulsive force command and a steering angle command to the outboard motor OM for the straight forward movement. Thus, the shift position of the outboard motor OM is set to the forward shift position F, and the output of the engine 23 (engine speed) is controlled according to the anteroposterior component of the tilt amount of the joystick 8. Further, the steering angle of the outboard motor OM is controlled to zero (neutral tilt position).

The main controller 50 sets a target azimuth by acquiring an output of the azimuth sensor 53 observed when the anteroposterior direction command is issued, and performs the azimuth holding control to maintain the hull azimuth at the target azimuth (reference character A2). That is, the main controller 50 applies a propulsive force command to the bow thruster BT so as to eliminate a deviation of a hull azimuth thereafter detected by the azimuth sensor 53 from the target azimuth (azimuth deviation). This makes it possible to move the hull 2 straight while maintaining the hull azimuth by utilizing the propulsive force of the bow thruster BT. That is, even if the hull azimuth is deviated due to an external disturbance 70, the azimuth deviation is automatically eliminated without the need for the user to perform an azimuth deviation eliminating operation.

If the user thereafter twists the joystick 8 to turn the hull 2 with the joystick 8 kept tilted forward (reference character A3), the main controller 50 performs a control operation to turn the hull 2. That is, the main controller 50 applies a steering angle command to the outboard motor OM based on a bow turning command issued thereto by the twisting of the joystick 8. Thus, the outboard motor OM is steered to apply a bow turning moment to the hull 2 such that the hull 2 is moved forward while being turned (reference character A4). The bow turning command is inputted to the main controller 50 by the twisting of the joystick 8, so that the main controller 50 stops the azimuth holding control.

In order to stop the turning of the hull 2, the user stops twisting the joystick 8 (reference character A5). When the twisting amount of the joystick 8 thus falls within the rotation insensitive zone, the bow turning command is no longer inputted and, therefore, the main controller 50 starts the azimuth holding control (reference character A6). Thus, a hull azimuth observed after the turning of the hull 2 is used as the target azimuth, and the azimuth holding control is performed by utilizing the propulsive force of the bow thruster BT.

When the user stops tilting the joystick 8, the joystick 8 is returned into the neutral tilt position. That is, the anteroposterior component of the tilt amount of the joystick 8 falls within the anteroposterior insensitive zone 81 (see FIG. 6), so that the anteroposterior direction command is no longer inputted to the main controller 50 (reference character A7). Correspondingly, the main controller 50 generates a propulsive force command to stop the output of the propulsive force of the outboard motor OM. Accordingly, the shift position of the outboard motor OM is set to the neutral shift position N so that the outboard motor OM no longer outputs the propulsive force. At this time, the hull 2 is moved in the previous traveling direction due to inertia.

Even without the input of the anteroposterior direction command, the main controller 50 continues the azimuth holding control for a predetermined period (e.g., 10 seconds) (reference character A8), and then stops the azimuth holding control after a lapse of the predetermined period. Since the hull azimuth is thus maintained even during the inertial movement of the hull 2, the user does not need to perform an azimuth correcting operation.

If the anteroposterior direction command is no longer issued, the main controller 50 starts measuring the predetermined period. If the anteroposterior direction command is issued again before the measurement of the predetermined period ends (reference character A9), however, the main controller 50 cancels the measurement of the period. Thus, the azimuth holding control is restarted, so that the period of the azimuth holding control is practically extended (reference character A10). When the azimuth holding control is restarted before the measurement of the predetermined period ends, the previous target azimuth may be used as it is. Alternatively, the target azimuth may be newly set based on a signal outputted by the azimuth sensor 53 when the azimuth holding control is restarted. Even in this case, substantially the same target azimuth as the previous target azimuth is set for the azimuth holding control to be continuously performed.

Figure 8A:
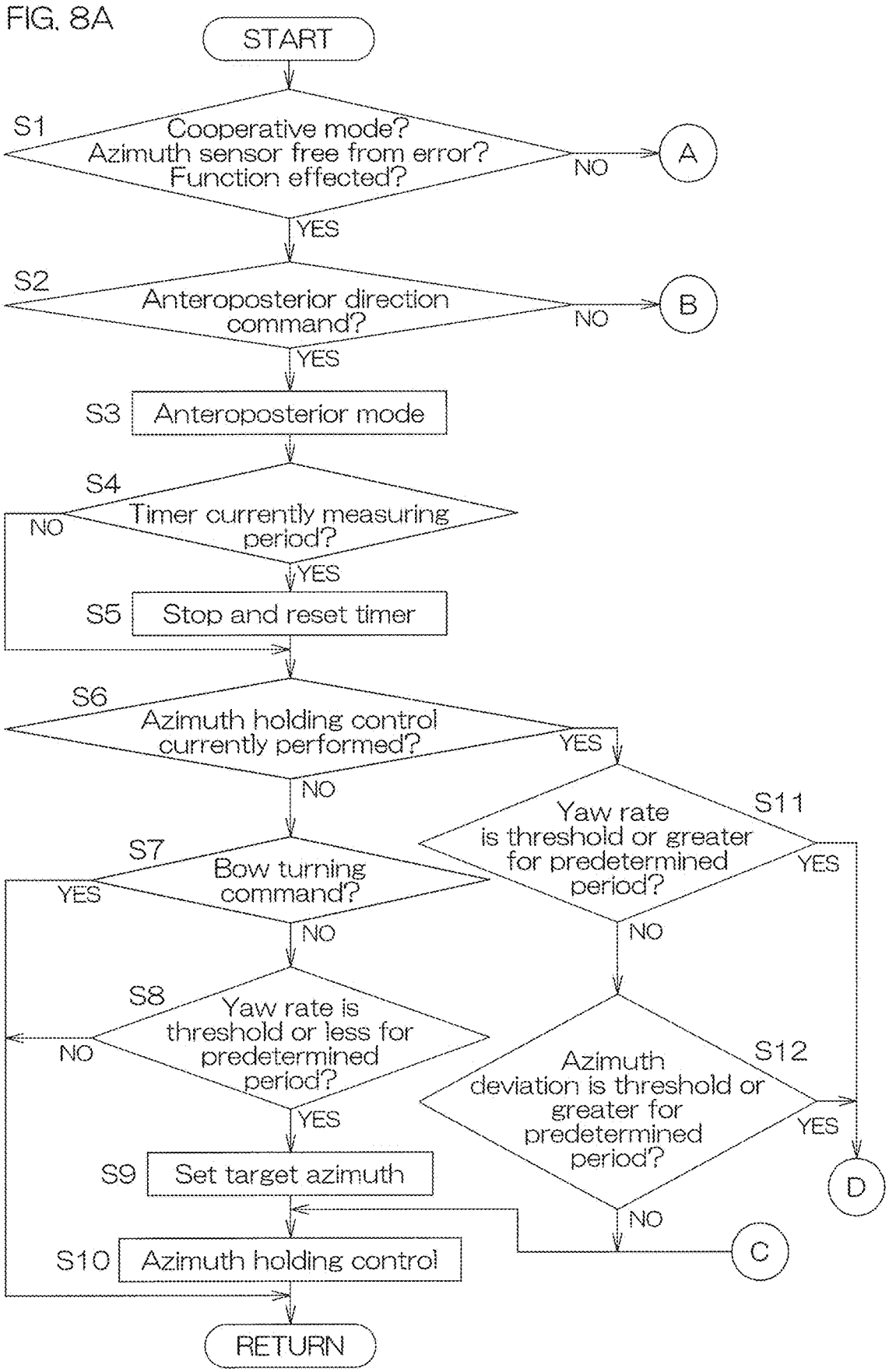
FIG. 8A is a flowchart for an exemplary process to be performed by a main controller in response to an anteroposterior direction command.
Figure 8B:
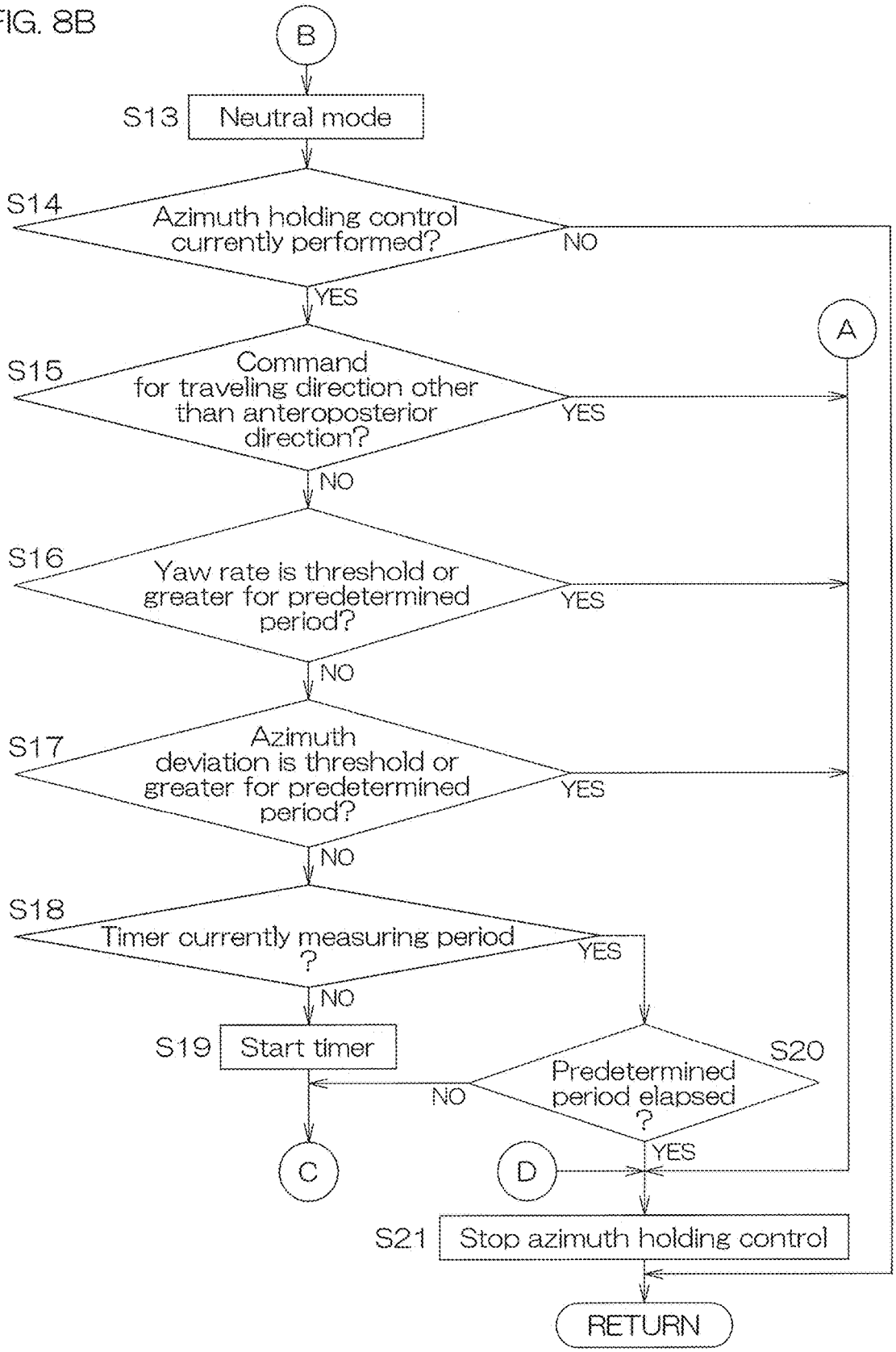
FIG. 8B is a flowchart for the exemplary process to be performed by the main controller in response to the anteroposterior direction command.

FIGS. 8A and 8B are flowcharts for an exemplary process to be performed by the main controller 50 in response to the anteroposterior direction command. The main controller 50 determines whether or not at least one of the following preconditions is satisfied (preferably, whether or not all the following preconditions are satisfied): a precondition that the main controller 50 is in the cooperative mode; a precondition that no error occurs in the azimuth sensor 53; and a precondition that the azimuth holding control function is effected (e.g., by operating the input device 10 of the gauge 9) when the hull 2 is moved in the anteroposterior direction (Step S1). If the preconditions are satisfied (NO in Step S1), the process ends. If the anteroposterior direction command is inputted (YES in Step S2) when the preconditions are satisfied (YES in Step S1), the main controller 50 is switched into the anteroposterior mode (Step S3), and then determines whether or not the bow turning command is inputted (Step S7) and whether or not the yaw rate of the hull 2 is equal to or less than a predetermined threshold for longer than a predetermined period (Step S8). If the twisting amount of the joystick 8 falls within the rotation insensitive zone, the main controller 50 determines that the bow turning command is not inputted. If the twisting amount of the joystick 8 falls outside the rotation insensitive zone, the main controller 50 determines that the bow turning command is inputted. The yaw rate of the hull 2 may be determined, for example, by time-differentiating the azimuth detected by the azimuth sensor 53.

In the anteroposterior mode, if no bow turning command is inputted (NO in Step S7) and if the yaw rate of the hull 2 is equal to or less than the predetermined threshold for longer than the predetermined period (YES in Step S8), the main controller 50 determines that a trigger condition for the start of the azimuth holding control is satisfied. If the trigger condition is satisfied, the main controller 50 sets a hull azimuth outputted at this time by the azimuth sensor 53 as the target azimuth (Step S9), and controls the bow thruster BT for the azimuth holding control (Step S10).

If the anteroposterior direction command is not inputted (NO in Step S2), the main controller 50 is switched into the neutral mode (Step S13). If the azimuth holding control is performed at this time (YES in Step S14), the main controller 50 checks whether or not its timer currently measures the predetermined period (e.g., 10 seconds) (Step S18). If the timer does not currently measure the period, the main controller 50 starts the timer (Step S19). If the timer currently measures the period (YES in Step S18), the main controller 50 checks whether or not the timer ends the measurement of the predetermined period (Step S20). When the timer is started (Step S19) or when the timer currently measures the predetermined period (NO in Step S20), a process sequence from Step S10 is performed. In these cases, the main controller 50 determines that a continuation condition for the continuation of the azimuth holding control is satisfied, and continuously performs the azimuth holding control by still using the previous target azimuth (Step S10).

If the predetermined period is elapsed after the main controller 50 is switched into the neutral mode with the anteroposterior direction command no longer inputted (YES in Step S20), the main controller 50 determines that a cancellation condition for the cancellation of the azimuth holding control is satisfied, and stops the azimuth holding control (Step S21).

If the anteroposterior direction command is inputted again (YES in Step S2) when the timer continues the measurement of the predetermined period, i.e., when the azimuth holding control continues after the anteroposterior direction command is no longer inputted, the main controller 50 is switched from the neutral mode into the anteroposterior mode (Step S3). At this time, because the timer continues the measurement of the predetermined period (YES in Step S4), the main controller 50 stops and resets the timer to cancel the measurement of the predetermined period (Step S5). The main controller 50 does not count up the timer until the main controller 50 is thereafter switched again into the neutral mode. In this case, the previous target azimuth is still used (YES in Step S6), and the azimuth holding control is continued (Step S10). At this time, as described above, the target azimuth may be newly set, and the azimuth holding control may be started based on the new target azimuth. It is noted that the timer may be reset immediately before the start of the timer (Step S19).

If the bow turning command is inputted (YES in Step S7) or if the yaw rate of the hull 2 is greater than the predetermined threshold for longer than the predetermined period (NO in Step S8), the main controller 50 does not start the azimuth holding control. Further, if the yaw rate of the hull 2 is equal to or greater than a predetermined threshold for longer than a predetermined period (YES in Step S11, S16) during the azimuth holding control (YES in Step S6, S14), the main controller 50 determines that the cancellation condition is satisfied, and stops the azimuth holding control (Step S21). Further, if the azimuth deviation is equal to or greater than a threshold for longer than a predetermined period (YES in Step S12, S17) during the azimuth holding control (YES in Step S6, S14), the main controller 50 also determines that the cancellation condition is satisfied, and stops the azimuth holding control (Step S21).

Further, when a command indicating a traveling direction nonparallel to the anteroposterior direction of the hull 2 is issued by the operation of the joystick 8 (NO in Step S2, NO in Step S14), the main controller 50 does not start the azimuth holding control. If the command indicating the traveling direction nonparallel to the anteroposterior direction of the hull 2 is given by the operation of the joystick 8 during the azimuth holding control (YES in Step S14, YES in Step S15), the main controller 50 determines that the cancellation condition is satisfied, and stops the azimuth holding control (Step S21).

According to the present example embodiment, as described above, if the anteroposterior direction command is issued to the main controller 50 by the operation of the joystick 8, the azimuth holding control is performed by utilizing the lateral propulsive force of the bow thruster BT. This alleviates a burden on the user (watercraft operator) to perform an operation against a change in bow azimuth due to an external disturbance or the like. This azimuth holding control is continued even after the anteroposterior direction command is no longer issued with the joystick 8 returned to the neutral tilt position. Thus, the azimuth of the hull 2 is maintained even during the inertial forward or reverse traveling of the hull 2. This continuously alleviates a burden on the user to perform an operation to correct an unintended change in bow azimuth. On the other hand, the azimuth holding control is continued only for the predetermined period and thereafter stopped such that the bow thruster BT is prevented from being continuously driven for a prolonged period longer than necessary. Thus, the watercraft propulsion system 100 is able to efficiently drive the bow thruster BT to properly perform the azimuth holding operation. The efficient driving of the bow thruster BT reduces the power consumption of a battery that supplies electric power to the bow thruster BT, and reduces the heat generated by the electric motor 42 (which is a power source of the bow thruster BT).

In the present example embodiment, the main controller 50 is configured or programmed to cancel the measurement of the predetermined period to continuously perform the azimuth holding control if the anteroposterior direction command is issued again by the operation of the joystick 8 during the azimuth holding control continued for the predetermined period. Thus, the azimuth holding control is restarted if the joystick 8 is operated again during the azimuth holding control to issue the anteroposterior direction command after the joystick 8 is returned to the neutral tilt position to nullify the anteroposterior direction command. This makes it possible to practically extend the period of the azimuth holding control by the operation of the joystick 8. Thus, the bow thruster BT is efficiently driven according to the intention of the user to properly perform the azimuth holding operation.

In the present example embodiment, the main controller 50 is configured or programmed not to start the azimuth holding control, when the bow turning command is inputted from the joystick unit 18 by the twisting of the joystick 8. Further, the main controller 50 is configured or programmed to stop the azimuth holding control if the bow turning command is inputted during the azimuth holding control. Therefore, the azimuth holding control is prevented from interfering with the bow turning command, thus making it possible to perform the watercraft maneuvering operation for the turning of the hull 2 and the fixed-point bow turning of the hull 2 by the twisting of the joystick 8.

In the present example embodiment, the main controller 50 is configured or programmed not to start the azimuth holding control, when the command indicating the traveling direction nonparallel to the anteroposterior direction of the hull 2 is issued by the operation of the joystick 8. Further, the main controller 50 is configured or programmed to stop the azimuth holding control currently continued if the commend indicating the traveling direction nonparallel to the anteroposterior direction of the hull 2 is issued by the operation of the joystick 8 during the azimuth holding control. This prevents the azimuth holding control from interfering with the movement of the hull 2 (particularly, involving the turning of the hull 2).

Figure 9:
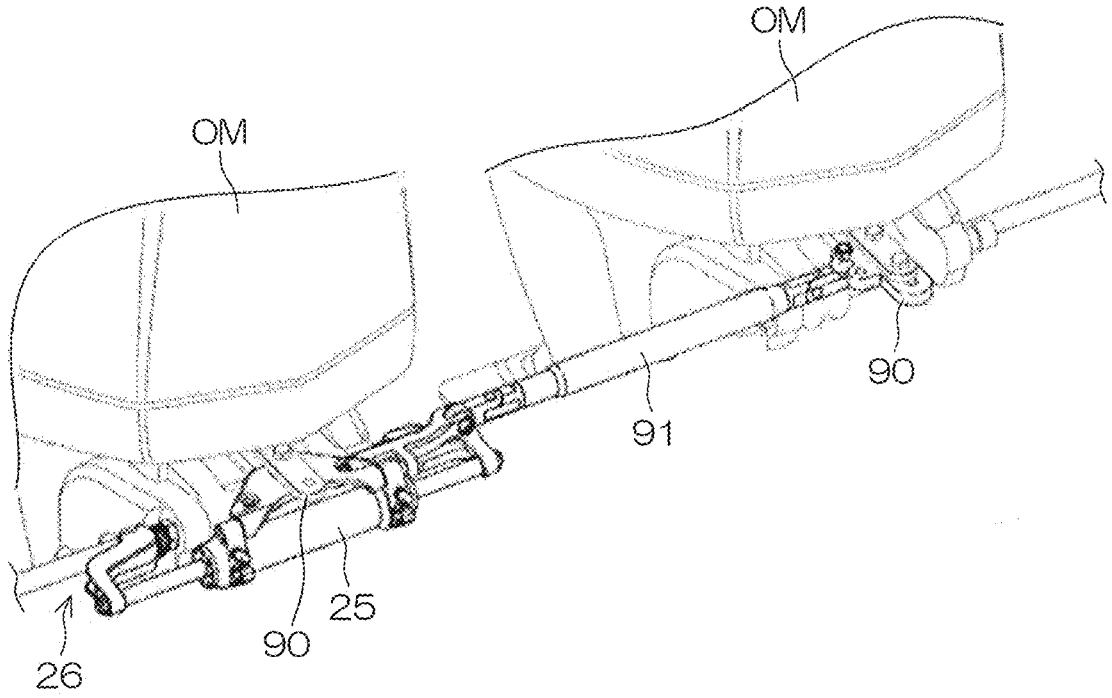
FIG. 9 is a diagram showing an arrangement of a watercraft propulsion system according to another example embodiment of the present invention.

FIG. 9 is a diagram showing an arrangement of a watercraft propulsion system according to another example embodiment of the present invention. In the example embodiments described above, the single propulsion device (single outboard motor OM) is provided on the stern of the hull 2 by way of an example. Alternatively, the example embodiments described above may be applied to an arrangement which includes a plurality of propulsion devices provided on the stern of the hull 2 and adapted to be steered at the same steering angle. In the example shown in FIG. 9, the steering levers 90 of the respective outboard motors OM provided on the stern are mechanically connected together by a link 91, and the outboard motors OM (in this example, two outboard motors OM) are steered in synchronism (i.e., at the same steering angle) by a single steering. In this example, the steering includes a steering actuator 25 and a steering mechanism 26 to be driven by the steering actuator 25.

The plurality of propulsion devices to be steered in synchronism at the same steering angle apply their propulsive forces in the same direction to the hull 2, but do not apply the propulsive forces simultaneously in different directions to the hull 2. In this aspect, a combination of the plurality of propulsion devices is equivalent to the single propulsion device. Therefore, the example embodiments described above are applicable to a watercraft propulsion system which includes a plurality of propulsion devices provided on the stern of a hull 2 and incapable of applying their propulsive forces simultaneously in different directions to the hull 2, and a bow thruster BT provided at the bow of the hull 2.

While the example embodiments of the present invention have thus been described, the invention may be embodied in some other ways.

In the example embodiments described above, the bow thruster BT is fixed to the hull 2 in the unsteerable manner. Alternatively, a steerable propulsion unit such as a trolling motor may be used as the bow thruster BT. The example embodiments described above are applicable even in this case.

The example embodiments described above include an exemplary case in which the single propulsion device is provided on the hull, and an exemplary case in which the plurality of propulsion devices to be steered at the same steering angle are provided on the hull. The example embodiments may be applied to a watercraft propulsion system including a plurality of propulsion devices provided on the hull and steerable at different steering angles.

In the example embodiments described above, the outboard motor is used as the propulsion device by way of an example, but the propulsion device may be in any of various types such as an inboard motor, an inboard/outboard motor, and a waterjet propulsion device. The propulsion device may be provided on a portion of the hull other than the stern.

In the example embodiments described above, the joystick unit 18 doubles as the twist operator by way of example, but a twist operator 15 separate from the joystick unit may be provided as shown in FIG. 1. Further, a traveling direction command generator other than the joystick unit may be used.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a bow thruster provided at a bow of a hull to generate a propulsive force laterally of the hull;

a propulsion device provided on the hull to generate a propulsive force anteroposteriorly of the hull;

a steering to change a course of the hull;

a joystick to be operated by a user to issue a traveling direction command to indicate a traveling direction of the hull, and tiltable from a neutral tilt position in all directions; and a controller configured or programmed to control the bow thruster, the propulsion device, and the steering according to an operation of the joystick; wherein the controller is configured or programmed to perform an azimuth holding control to maintain an azimuth of the hull by controlling the bow thruster when an anteroposterior direction command is issued to indicate a traveling direction parallel to an anteroposterior direction of the hull by an operation of the joystick, and to stop the azimuth holding control after the azimuth holding control is continued for a predetermined period of time when the anteroposterior direction command is no longer issued with the joystick returned to the neutral tilt position during the azimuth holding control; and the controller is configured or programmed to cancel measurement of the predetermined period of time and perform the azimuth holding control when the anteroposterior direction command is issued again by the operation of the joystick during the azimuth holding control continued for the predetermined period of time.

2. A watercraft propulsion system comprising:

a bow thruster provided at a bow of a hull to generate a propulsive force laterally of the hull;

a propulsion device provided on the hull to generate a propulsive force anteroposteriorly of the hull;

a steering to change a course of the hull;

a joystick to be operated by a user to issue a traveling direction command to indicate a traveling direction of the hull, and tiltable from a neutral tilt position in all directions; and a controller configured or programmed to control the bow thruster, the propulsion device, and the steering according to an operation of the joystick; wherein the controller is configured or programmed to perform an azimuth holding control to maintain an azimuth of the hull by controlling the bow thruster when an anteroposterior direction command is issued to indicate a traveling direction parallel to an anteroposterior direction of the hull by an operation of the joystick, and to stop the azimuth holding control after the azimuth holding control is continued for a predetermined period of time when the anteroposterior direction command is no longer issued with the joystick returned to the neutral tilt position during the azimuth holding control;

the joystick doubles as a twist operator to be operated by the user to issue a bow turning command to indicate bow turning of the hull, and twistable leftward and rightward from a neutral twist position; and the controller is configured or programmed not to start the azimuth holding control when the bow turning command is inputted from the joystick, and to stop the azimuth holding control when the bow turning command is inputted from the joystick during the azimuth holding control.

3. A watercraft propulsion system comprising:

a bow thruster provided at a bow of a hull to generate a propulsive force laterally of the hull;

a propulsion device provided on the hull to generate a propulsive force anteroposteriorly of the hull;

a steering to change a course of the hull;

a joystick to be operated by a user to issue a traveling direction command to indicate a traveling direction of the hull, and tiltable from a neutral tilt position in all directions; and a controller configured or programmed to control the bow thruster, the propulsion device, and the steering according to an operation of the joystick; wherein the controller is configured or programmed to perform an azimuth holding control to maintain an azimuth of the hull by controlling the bow thruster when an anteroposterior direction command is issued to indicate a traveling direction parallel to an anteroposterior direction of the hull by an operation of the joystick, and to stop the azimuth holding control after the azimuth holding control is continued for a predetermined period of time when the anteroposterior direction command is no longer issued with the joystick returned to the neutral tilt position during the azimuth holding control;

the watercraft propulsion system further comprises a twist operator to be operated by the user to issue a bow turning command to indicate bow turning of the hull, and rotatable leftward and rightward from a neutral twist position; and the controller is configured or programmed not to start the azimuth holding control when the bow turning command is inputted from the twist operator, and to stop the azimuth holding control when the bow turning command is inputted from the twist operator during the azimuth holding control.

4. A watercraft propulsion system comprising:

a bow thruster provided at a bow of a hull to generate a propulsive force laterally of the hull;

a propulsion device provided on the hull to generate a propulsive force anteroposteriorly of the hull;

a steering to change a course of the hull;

a joystick to be operated by a user to issue a traveling direction command to indicate a traveling direction of the hull, and tiltable from a neutral tilt position in all directions; and a controller configured or programmed to control the bow thruster, the propulsion device, and the steering according to an operation of the joystick; wherein the controller is configured or programmed to perform an azimuth holding control to maintain an azimuth of the hull by controlling the bow thruster when an anteroposterior direction command is issued to indicate a traveling direction parallel to an anteroposterior direction of the hull by an operation of the joystick, and to stop the azimuth holding control after the azimuth holding control is continued for a predetermined period of time when the anteroposterior direction command is no longer issued with the joystick returned to the neutral tilt position during the azimuth holding control; and the controller is configured or programmed not to start the azimuth holding control when a command indicating a traveling direction nonparallel to the anteroposterior direction of the hull is issued by the operation of the joystick, and to stop the azimuth holding control when the command indicating the traveling direction nonparallel to the anteroposterior direction of the hull is issued by the operation of the joystick during the azimuth holding control.

5. The watercraft propulsion system according to claim 1, wherein the bow thruster is fixed to the hull in an unsteerable manner.

6. A watercraft comprising:

a hull; and the watercraft propulsion system according to claim 1.

7. A watercraft comprising:

a hull; and the watercraft propulsion system according to claim 2.

8. A watercraft comprising:

a hull; and the watercraft propulsion system according to claim 3.

9. A watercraft comprising:

a hull; and the watercraft propulsion system according to claim 4.

* * * * *